US010029481B2

(12) United States Patent
Ohnishi et al.

(10) Patent No.: US 10,029,481 B2
(45) Date of Patent: Jul. 24, 2018

(54) POROUS BODY, METHOD FOR PRODUCING THE POROUS BODY, INK JET RECORDING METHOD, AND INK JET RECORDING APPARATUS

(71) Applicant: CANON KABUSHIKI KAISHA, Tokyo (JP)

(72) Inventors: Toru Ohnishi, Yokohama (JP); Noboru Toyama, Kawasaki (JP); Hiroe Ishikura, Kawasaki (JP); Osamu Yoshitake, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/411,158

(22) Filed: Jan. 20, 2017

(65) Prior Publication Data

US 2017/0217215 A1 Aug. 3, 2017

(30) Foreign Application Priority Data

Jan. 29, 2016 (JP) ..... 2016-016278

(51) Int. Cl.
*B41J 11/00* (2006.01)

(52) U.S. Cl.
CPC ..... *B41J 11/0015* (2013.01)

(58) Field of Classification Search
CPC ..... B41J 11/0015; B41J 11/002
USPC ..... 347/31, 101–105
See application file for complete search history.

(56) References Cited

U.S. PATENT DOCUMENTS 5,841,456 A * 11/1998 Takei ..... B41J 2/0057 347/101
2005/0212884 A1* 9/2005 Ueki ..... B41J 11/0065 347/105
2006/0214984 A1* 9/2006 Hirakawa ..... B41J 2/2114 347/31

(Continued)

FOREIGN PATENT DOCUMENTS

JP 2001-179959 A 7/2001
JP 2005-161610 A 6/2005
JP 2009-45851 A 3/2009

OTHER PUBLICATIONS

U.S. Appl. No. 15/414,714, filed Jan. 25, 2017, Miyakoshi et al.

*Primary Examiner* — Huan Tran
*Assistant Examiner* — Alexander D Shenderov
(74) *Attorney, Agent, or Firm* — Fitzpatrick, Cella, Harper & Scinto

(57) ABSTRACT

A method for producing a porous body for use in an ink jet recording apparatus including an image forming unit configured to form a first image including a first liquid and a coloring material on an ink receiving medium, and a liquid absorbing member including the porous body that contacts with the first image to absorb part of the first liquid from the first image. The method includes laminating a first porous layer that contacts with the first image and includes a first resin, and a second and a third porous layer including a second and a third resin; and heating the laminated first to third porous layers, wherein the second porous layer has a void when viewed in a thickness direction, and softening temperatures T1 through T3 of the first to third resins and heating temperature T in heating the first to third porous layers satisfy T2<T, T<T1, T<T3.

24 Claims, 6 Drawing Sheets

(56) References Cited

U.S. PATENT DOCUMENTS

2007/0014944 A1* 1/2007 Matsumoto ..... B29C 43/003
428/32.81

* cited by examiner

POROUS BODY, METHOD FOR PRODUCING THE POROUS BODY, INK JET RECORDING METHOD, AND INK JET RECORDING APPARATUS

BACKGROUND OF THE INVENTION

Field of the Invention

The present invention relates to a porous body, a method for producing the porous body, an ink jet recording method, and an ink jet recording apparatus.

Description of the Related Art

In an ink jet recording technique, an image is formed by applying a liquid composition (ink) including a coloring material directly or indirectly onto a recording medium. At this time, curling or cockling occurs because of excessive absorption of a liquid component in the ink by the recording medium.

To prevent such a problem, there have been proposed techniques for quickly removing liquid components in the ink, such as a technique of drying a recording medium with, for example, warm air or infrared rays, and a technique for forming an image on a transfer body, drying liquid components included in the image on the transfer body with, for example, thermal energy, and then transferring the image onto a recording medium such as paper.

Another proposed technique for removing liquid components included in an image on a transfer body is a technique of bringing a roller-shaped porous body into contact with an ink image to absorb and remove liquid components from the ink image without using thermal energy (see Japanese Patent Application Laid-Open Nos. 2009-45851 and 2005-161610). Still another proposed technique is a technique of bringing a belt-shaped polymeric absorbent into contact with an ink image to absorb and remove liquid components from the ink image (see Japanese Patent Application Laid-Open No. 2001-179959).

SUMMARY OF THE INVENTION

The present invention is directed to a porous body that is applicable to an ink jet recording apparatus which can reduce the smeared image and includes a liquid absorbing member having a high conveyance strength, and a method for producing the porous body. The present invention is also directed to providing an ink jet recording method using the porous body. The present invention is also directed to providing an ink jet recording apparatus including the porous body.

In an aspect of the present invention, there is provided a method for producing a porous body for use in an ink jet recording apparatus including an image forming unit configured to form a first image including a first liquid and a coloring material on an ink receiving medium, and a liquid absorbing member including the porous body that comes into contact with the first image to absorb at least a part of the first liquid from the first image, and the method including the steps of laminating a first porous layer that comes into contact with the first image and includes a first resin, a second porous layer including a second resin, and a third porous layer including a third resin; and heating the laminated first to third porous layers, wherein the second porous layer has a void when viewed in a thickness direction, and wherein a softening temperature T1 (° C.) of the first resin, a softening temperature T2 (° C.) of the second resin, a softening temperature T3 (° C.) of the third resin, and a heating temperature T (° C.) in the step of heating the first to third porous layers satisfy the relationships T2<T, T<T1, and T<T3.

In another aspect of the present invention, there is provided a porous body for use in an ink jet recording apparatus including an image forming unit configured to form a first image including a first liquid and a coloring material on an ink receiving medium, and a liquid absorbing member including the porous body that comes into contact with the first image to absorb at least a part of the first liquid from the first image, the porous body including a first porous layer that comes into contact with the first image and includes a first resin, a second porous layer including a second resin and a third porous layer including a third resin in this order, wherein the second porous layer has a void when viewed in a thickness direction, and wherein the second resin enters pores in the first porous layer and in the third porous layer so that the first to third porous layers are bonded together.

In still another aspect of the present invention, there is provided an ink jet recording method including the steps of forming a first image including a first liquid and a coloring material on an ink receiving medium; and bringing the above-described porous body into contact with the first image so that the porous body absorbs at least a part of the first liquid from the first image.

In still another aspect of the present invention, there is provided an ink jet recording apparatus including an image forming unit configured to form a first image including a first liquid and a coloring material on an ink receiving medium; and a liquid absorbing member including the above-described porous body that comes into contact with the first image to absorb at least a part of the first liquid from the first image.

In yet another aspect of the present invention, there is provided an ink jet recording apparatus including an image forming unit configured to form a first image by applying an ink contains a first liquid and a coloring material on an ink receiving medium, and a liquid absorbing member including the porous body that comes into contact with the first image to concentrate the ink constituting the first image, the porous body including a first porous layer that comes into contact with the first image and includes a first resin, a second porous layer including a second resin and a third porous layer including a third resin in this order, wherein the second porous layer has a void when viewed in a thickness direction, and wherein the second resin enters pores in the first porous layer and in the third porous layer so that the first to third porous layers are bonded together.

Further features of the present invention will become apparent from the following description of exemplary embodiments with reference to the attached drawings.

DESCRIPTION OF THE EMBODIMENTS

Figure 1:
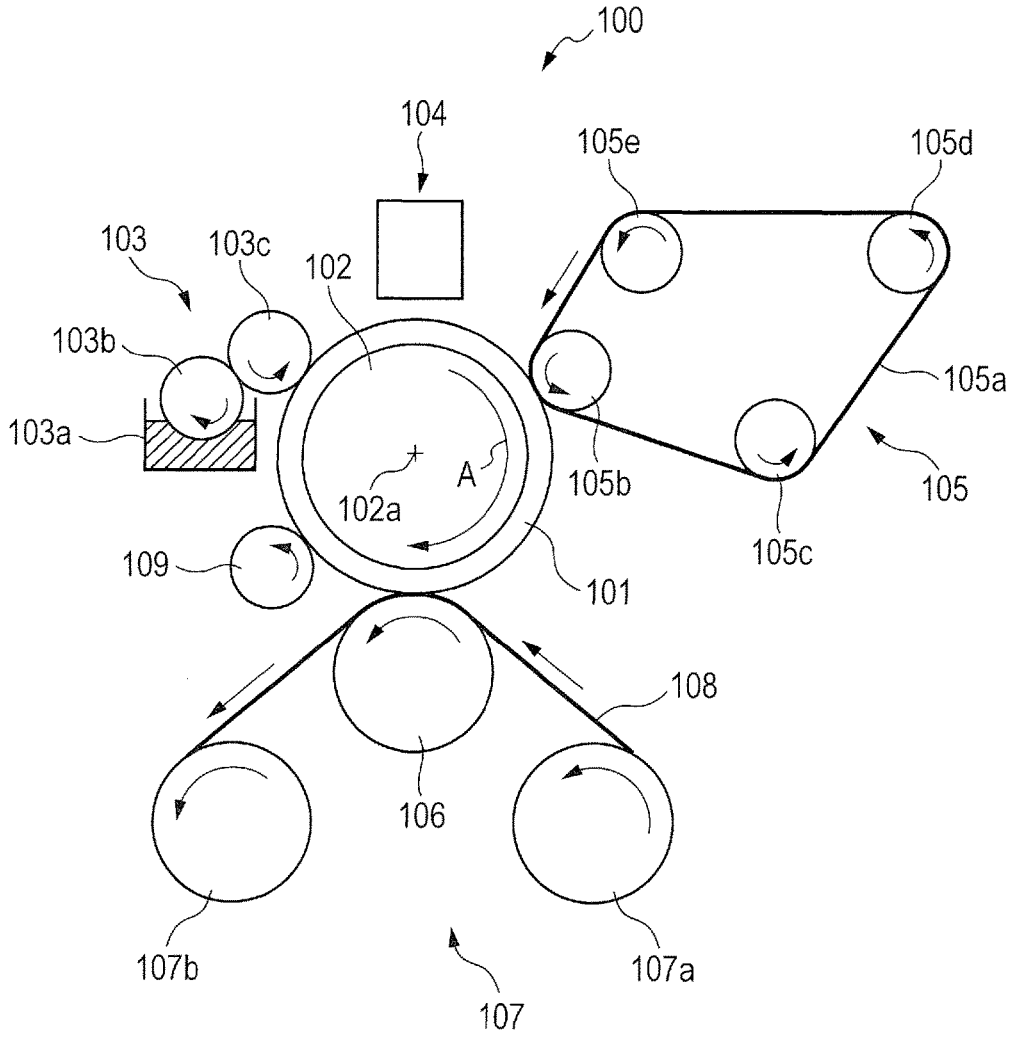
FIG. 1 schematically illustrates an example configuration of a transfer type ink jet recording apparatus according to an embodiment of the present invention.

Preferred embodiments of the present invention will now be described in detail in accordance with the accompanying drawings.

In the techniques described in Japanese Patent Application Laid-Open Nos. 2009-45851, 2005-161610, and 2001-179959, in absorbing and removing a liquid component from an ink image on a transfer body, there arises a so-called "smeared image" in which liquid components, coloring materials, and solid components except the coloring materials included in an ink, for example, are partially caused to flow to the rearward of the image. In a case where a member for absorbing and removing liquid components in order to enhance absorption of the liquid components is constituted by a plurality of porous layers, the porous layers may be peeled off from one another at the interfaces while the member is conveyed.

Inventors of the present invention have intensively studied to provide a porous body that is applicable to an ink jet recording apparatus which can reduce the smeared image and includes a liquid absorbing member having a high conveyance speed, thereby achieving the present invention.

An embodiment of the present invention will be specifically described with reference to a preferred embodiment.

An ink jet recording apparatus using a porous body according to the present invention includes an image forming unit configured to form a first image including a first liquid and a coloring material on an ink receiving medium, and a liquid absorbing member that includes the porous body according to the present invention and comes into contact with the first image to absorb at least a part of the first liquid from the first image. The liquid absorbing member including the porous body is brought into contact with the first image including the first liquid and the coloring material on the ink receiving medium so that at least a part of the first liquid is removed from the first image. Consequently, curling or cockling caused by excessive absorption of the first liquid in the first image by a recording medium such as paper can be reduced. It is sufficient that at least a part of the first liquid is absorbed by the liquid absorbing member, and the entire first liquid does not need to be absorbed.

A method for producing a porous body according to the present invention includes the steps of laminating a first porous layer that comes into contact with the first image and includes a first resin, a second porous layer including a second resin, a third porous layer including a third resin; and heating the laminated first to third porous layers. The second porous layer has a void when viewed in a thickness direction. The softening temperature T1 (° C.) of the first resin, the softening temperature T2 (° C.) of the second resin, the softening temperature T3 (° C.) of the third resin, and the heating temperature T (° C.) in the step of heating the first to third porous layers satisfy the relationships $T2<T$, $T<T1$, and $T<T3$. When these relationships are satisfied, only the second porous layer is melted while maintaining pores upon heating, and the first to third porous layers are bonded together. Thus, a sufficient adhesion strength is obtained among the layers with air permeability being maintained. Accordingly, conveyance strength can be enhanced while reducing the smeared image.

The porous body according to the present invention includes a first porous layer that comes into contact with the first image and includes a first resin, a second porous layer including a second resin, and a third porous layer including a third resin, in this order. The second porous layer has a void when viewed in a thickness direction. The second resin enters pores in the first porous layer and in the third porous layer so that the first to third porous layers are bonded together. When these conditions are satisfied, a sufficient strength is obtained among the layers with air permeability being maintained. Accordingly, conveyance strength can be enhanced with the smeared image reduced.

An ink jet recording method according to the present invention includes the steps of forming a first image including a first liquid and a coloring material on an ink receiving medium; and bringing the porous body according to the present invention into contact with the first image so that the porous body absorbs at least a part of the first liquid from the first image. In the ink jet recording method according to the present invention, the porous body according to the present invention is preferably used.

An ink jet recording apparatus according to the present invention includes an image forming unit configured to form a first image including a first liquid and a coloring material on an ink receiving medium, and a liquid absorbing member that includes the porous body according to the present invention and comes into contact with the first image to absorb at least a part of the first liquid from the first image. In the ink jet recording apparatus according to the present invention, the porous body according to the present invention is preferably used.

In the ink jet recording apparatus according to the present invention, the image forming unit is not specifically limited as long as a first image including a first liquid and a coloring material can be formed on an ink receiving medium. Preferably, the ink jet recording apparatus includes (1) an apparatus that applies a first liquid composition including the first liquid or a second liquid, and an ink-viscosity-increasing component onto the ink receiving medium and (2) an apparatus that applies a second liquid composition including the first or second liquid and the coloring material onto the ink receiving medium, and forms the first image as a mixture of the first and second liquid compositions. The second liquid composition is typically an ink including a coloring material, and the apparatus that applies the second liquid composition onto the ink receiving medium is an ink jet recording device. The first liquid composition includes a component (ink-viscosity-increasing component) that chemically or physically acts on the second liquid composition so that the mixture of the first and second liquid compositions is viscously thickened more than each of the first and second liquid compositions. At least one of the first and second liquid compositions includes the first liquid. The first liquid includes a liquid that has a low volatility at ordinary temperature (room temperature), especially includes water. The second liquid is a liquid except the first liquid, and may have any volatility but preferably has a volatility higher than that of the first liquid. The arrangement of the apparatus that applies the first liquid composition onto the ink receiving medium and the apparatus that applies the second liquid composition onto the ink receiving medium within the ink jet recording apparatus is not specifically limited. However, from the point of view of obtaining an image with higher image quality, it is preferable to undergo a step of applying the first liquid composition onto the ink receiving medium and then a step of applying the second liquid composition onto the ink receiving medium such that the second liquid composition overlaps with at least a part of a region on which the first liquid composition has been applied. Consequently, it is preferable that the apparatus that applies the first liquid composition onto the ink receiving medium and the apparatus that applies the second liquid composition onto the ink receiving medium are arranged so as to make it possible to apply the first liquid composition onto the ink receiving medium and apply the second liquid composition onto the ink receiving medium such that the second liquid composition overlaps with at least a part of a region on which the first liquid composition has been applied. The first liquid composition will also be hereinafter referred to as "reaction liquid," and a device that applies the first liquid composition onto the ink receiving medium will also be hereinafter referred to as "reaction liquid applying device." The second liquid composition will also be hereinafter referred to as "ink" and a device that applies the second liquid composition onto the ink receiving medium will also be hereinafter referred to as "ink applying device." The first image is an ink image before liquid removal before being subjected to a liquid absorbing process by the liquid absorbing member, and a second image is an ink image after liquid removal after being subjected to a liquid absorbing process with the liquid component content reduced.

Reaction Liquid Applying Device

The reaction liquid applying device may be any device that can apply a reaction liquid onto an ink receiving medium, and various known devices may be used as appropriate. Specifically, examples of the reaction liquid applying device include a gravure offset roller, an ink jet head, a die coating device (die coater), and a blade coating device (blade coater). The application of the reaction liquid by the reaction liquid applying device may be performed before application of an ink or after application of the ink as long as the reaction liquid can be mixed (react) with the ink on an ink receiving medium. Preferably, the reaction liquid is applied before application of the ink. The application of the reaction liquid before application of the ink can suppress bleeding in which adjacently applied inks are mixed and beading in which a previously impacting ink is attracted to a subsequently impacting ink, in image recording by an ink jet technique.

Reaction Liquid

The reaction liquid includes a component that increases the viscosity of ink (ink-viscosity-increasing component). The increase of ink viscosity here refers to a phenomenon that components constituting the ink, such as a coloring material and a resin, come into contact with the ink-viscosity-increasing component to cause chemical reaction therewith or physical adsorption thereonto, so that an increase of the viscosity of the entire ink is observed. This increase of the ink viscosity includes not only a case where an increase of the ink viscosity is observed but also a case where the viscosity locally increases because of aggregation of some of components constituting the ink such as a coloring material and a resin. The ink-viscosity-increasing component has an effect of reducing fluidity of the ink and/or some of components constituting the ink on an ink receiving medium to suppress bleeding and beading in forming a first image. In the present invention, the increase of the ink viscosity will also be hereinafter referred to as "viscously thickening the ink." As such an ink-viscosity-increasing component, known materials such as polyvalent metal ions, organic acids, cationic polymers, and porous fine particles may be used. In particular, polyvalent metal ions and organic acids are preferably used. A plurality of types of ink-viscosity-increasing components may be preferably included. The content of the ink-viscosity-increasing component in the reaction liquid is preferably 5 mass % or more of the total mass of the reaction liquid.

Examples of the polyvalent metal ions include divalent metal ions such as $Ca^{2+}$, $cu^{2+}$, $Ni^{2+}$, $Mg^{2+}$, $Sr^{2+}$, $Ba^{2+}$, and $Zn^{2+}$ and trivalent metal ions such as $Fe^{3+}$, $Cr^{3+}$, $Y^{3+}$, and $Al^{3+}$.

Examples of the organic acids include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumalic acid, thiophene carboxylic acid, nicotinic acid, oxysuccinic acid, and dioxysuccinic acid.

The reaction liquid may include an appropriate amount of water or of a low-volatile organic solvent, as the first liquid. Water used in this case is preferably water deionized by, for example, ion exchange. The organic solvent that can be used for the reaction liquid applicable to the present invention is not specifically limited, and any known organic solvent may be used.

In using the reaction liquid, the surface tension and the viscosity of the reaction liquid can be adjusted as necessary by adding a surfactant or a viscosity modifier. Any material that can coexist with the ink-viscosity-increasing component may be used. Specific examples of the surfactant include an acetylene glycol ethylene oxide adduct (trade name: "Acetylenol E100" manufactured by Kawaken Fine Chemicals Co., Ltd.) and a perfluoroalkyl ethylene oxide adduct (trade name: "Megafac F444" manufactured by DIC Corporation).

Ink Applying Device

As an ink applying device that applies an ink, an ink jet head is used. The ink jet head may be of a type that discharges an ink by causing film boiling in the ink by an electrothermal converter and, thereby, forms bubbles, a type that discharges an ink with an electromechnical converter, or a type that discharges an ink by using static electricity. In the present invention, a known ink jet head may be used. In particular, from the viewpoint of printing at high speed with high density, the type that uses an electrothermal converter is preferably used. In image formation, an image signal is received, and an ink in an amount necessary for each location is applied.

The amount of ink application can be expressed as an image density (duty) or an ink thickness, and in the present invention, the amount of ink application ($g/m^2$) is expressed as an average value obtained by multiplying the mass of each ink dot by the number of applied dots followed by being divided by a printed area. A maximum amount of ink applied on an image region refers to an amount of ink applied on at least an area of 5 $mm^2$ or more in a region used as information of an ink receiving medium, from the viewpoint of removing liquid components of the ink.

An ink jet recording apparatus according to the present invention may include a plurality of ink jet heads in order to apply inks of colors on an ink receiving medium. In the case of forming color images using a yellow ink, a magenta ink, a cyan ink, and a black ink, the ink jet recording apparatus includes four ink jet heads that respectively discharge the four types of inks onto the ink receiving medium.

The ink applying device may include an ink jet head that discharges an ink including no coloring materials (clear ink).

Ink

Components of an ink applied to the present invention will be described.

Coloring Material

As a coloring material included in the ink applied to the present invention, preferably contains a pigment. For example, the pigment or a mixture of the pigment and a dye may be used as the coloring material. The pigment that can be used as a coloring material is not specifically limited. Specific examples of the pigment include inorganic pigments such as carbon black; and organic pigments such as an azo-based pigment, a phthalocyanine-based pigment, a quinacridone-based pigment, an isoindolinone-based pigment, an imidazolone-based pigment, a diketo-pyrrolo-pyrrole-based pigment, and a dioxazine-based pigment. These pigments may be used singly or two or more of the pigments may be used in combination.

The dye that can be used as a coloring material is not specifically limited. Specific examples of the dye include a direct dye, an acid dye, a basic dye, a disperse dye, and a food dye, and a die having an anionic group may also be used. Specific examples of a dye skeleton include an azo skeleton, a triphenylmethane skeleton, a phthalocyanine skeleton, an azaphthalocyanine skeleton, a xanthene skeleton, and an anthrapyridone skeleton.

The content of the pigment in the ink is preferably 0.5 mass % or more to 15.0 mass % or less and more preferably 1.0 mass % or more to 10.0 mass % or less of the total mass of the ink.

Dispersant

As a dispersant for dispersing a pigment, a known dispersant for an ink jet ink may be used. In particular, in an aspect of the present invention, a water-soluble dispersant having a hydrophilic part and a hydrophobic part in its structure is preferably used. In particular, a pigment dispersant formed of a copolymerized resin including at least a hydrophilic monomer and a hydrophobic monomer is preferably used. The monomers used here are not specifically limited, and known monomers are preferably used. Specific examples of the hydrophobic monomer include styrene and other styrene derivatives, alkyl(meth)acrylate, and benzyl (meth)acrylate. Examples of the hydrophilic monomer include acrylic acid, methacrylic acid, and maleic acid.

The dispersant preferably has an acid value of 50 mgKOH/g or more to 550 mgKOH/g or less. The dispersant preferably has a weight-average molecular weight of 1000 or more to 50000 or less. The mass ratio of the pigment to the dispersant (pigment:dispersant) is preferably in the range from 1:0.1 to 1:3.

It is also preferable in the present invention to replace the dispersant with a so-called self-dispersible pigment in which the surface of the pigment itself is modified so that the pigment can be dispersed.

Resin Fine Particles

The ink applied to the present invention can be used while containing various types of fine particles including no coloring materials. In particular, resin fine particles are preferably used because the resin fine particles can effectively enhance image quality and fixability.

The material of the resin fine particles applicable to the present invention is not specifically limited, and any known resin may be used as appropriate. Specific examples of such a resin include monopolymers such as polyolefin, polystyrene, polyurethane, polyester, polyether, polyurea, polyamide, polyvinyl alcohol, poly(meth)acrylic acid and a salt thereof, poly(meth)acrylic acid alkyl, and polydiene, and copolymers obtainable by polymerizing a plurality of types of monomers for producing these monopolymers. The resin preferably has a weight-average molecular weight (Mw) of 1,000 or more to 2,000,000 or less. The amount of resin fine particles in the ink is preferably 1 mass % or more to 50 mass % or less and more preferably 2 mass % or more to 40 mass % or less of the total mass of the ink.

In an aspect of the present invention, the resin fine particles are preferably used as a resin fine particle dispersion in which the resin fine particles are dispersed in a liquid. The dispersion technique is not specifically limited, and a so-called self-dispersing type resin fine particle dispersion in which particles are dispersed by using a resin obtained by homopolymerizing or copolymerizing one or more types of monomers having a dissociable group is preferably employed. Examples of the dissociable group include a carboxyl group, a sulfonic acid, and a phosphoric acid. Examples of the monomer having such a dissociable group include acrylic acid and methacrylic acid. Similarly, a so-called emulsion-dispersion type resin fine particle dispersion in which resin fine particles are dispersed by an emulsifier is also preferably used in the present invention. The emulsifier here is preferably a known surfactant, irrespective of whether the molecular weight of the surfactant is low or high. The surfactant is preferably a nonionic surfactant or a surfactant having the same charge as that of resin fine particles.

The resin fine particle dispersion used in an aspect of the present invention preferably has a dispersed particle size of 10 nm or more to 1000 nm or less, more preferably has a dispersed particle size of 50 nm or more to 500 nm or less, and much more preferably has a dispersed particle size of 100 nm or more to 500 nm or less.

In producing the resin fine particle dispersion for use in an aspect of the present invention, various types of additives are preferably added for stability. Examples of the additives include n-hexadecane, dodecyl methacrylate, stearyl methacrylate, chlorobenzene, dodecylmercaptan, a blue dye (bluing agent), and polymethyl methacrylate.

Curing Component

In the present invention, the reaction liquid or the ink preferably includes a component that is cured with activation energy rays. Curing of a component that is cured with activation energy rays before a liquid absorbing process can reduce coloring material adhesion to the liquid absorbing member.

As the component that is cured by application of activation energy rays for use in the present invention, a component that is cured by application of activation energy rays to be more insoluble than before the application is used. As an example of such a component, a typical ultraviolet curable resin may be used. Many ultraviolet curable resins are not water-soluble. A material applicable to a water-based ink that is preferably used in the present invention, however, preferably includes, in its structure, at least an ethylenic unsaturated bond curable with ultraviolet rays and has a hydrophilic linking group. Examples of the hydrophilic linking group include a hydroxyl group, a carboxyl group, a phosphate group, a sulfonic group, salts of these groups, an ether linkage, and an amide linkage.

The curable component used in the present invention is preferably hydrophilic.

Examples of the activation energy rays include ultraviolet rays, infrared rays, and electron rays.

In the present invention, any one of the reaction liquid or the ink preferably includes a polymerization initiator. The polymerization initiator used in the present invention may be any compound that generates radicals upon application of activation energy rays.

To enhance a reaction rate, a sensitizing agent that increases an absorption wavelength of light may also be used, which is a very preferable embodiment.

Surfactant

Ink that can be used in the present invention may include a surfactant. Specific examples of the surfactant include an acetylene glycol ethylene oxide adduct (trade name: "Acetylenol E100", manufactured by Kawaken Fine Chemicals Co., Ltd.). The amount of the surfactant in the ink is preferably 0.01 mass % or more to 5.0 mass % or less of the total mass of the ink.

Water and Water-soluble Organic Solvent

Ink used in the present invention may include water and/or a water-soluble organic solvent. Water used in this case is preferably water deionized by, for example, ion exchange. The content of water in the ink is preferably 30 mass % or and 97 mass % or less and more preferably 50 mass % or more to 95 mass % or less of the total mass of the ink.

The water-soluble organic solvent used in the present invention is not specifically limited, and any known organic solvent may be used. Specific examples of the organic solvent include glycerin, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol, and methanol. Two or more of these organic solvents may be used in combination, of course.

The content of the water-soluble organic solvent in the ink is preferably 3 mass % or more to 70 mass % or less of the total mass of the ink.

Other Additives

Ink that can be used in the present invention may include various additives as necessary, such as a pH adjuster, a rust preventive, an antiseptic agent, a mildew proofing agent, an oxidation inhibitor, an antireduction agent, a water-soluble resin, a neutralizer for a water-soluble resin, and a viscosity modifier, in addition to the components described above.

Liquid Absorbing Member

In the present invention, at least a part of the first liquid is brought into contact with a liquid absorbing member including a porous body to be absorbed from a first image so that the content of a liquid component in the first image is reduced. The surface of the liquid absorbing member that is brought into contact with the first image is a first surface on which the porous body is disposed. The liquid absorbing member including such a porous body preferably has such a shape as to enable circulation and absorption in such a manner that the liquid absorbing member moves in conjunction with movement of an ink receiving medium to come into contact with a first image and thereafter comes into contact with another first image again in a predetermined cycle. Examples of such a shape include an endless belt shape and a drum shape.

Porous Body and Method for Producing Porous Body

Porous body and method for producing porous body will be described below.

In the present invention, the porous body has only to be a material having numerous pores. The porous body of the present invention includes a material having numerous pores formed by mutual crossing of fibers, for example.

A method for producing a porous body according to the present invention includes the steps of laminating a first porous layer that comes into contact with the first image and includes a first resin, a second porous layer including a second resin, and a third porous layer including a third resin; and heating the laminated first to third porous layers. The second porous layer has a void when viewed in a thickness direction. Softening temperatures T1 (° C.), T2 (° C.), and T3 (° C.) of the first, second, and third resins and a heating temperature T (° C.) of heating the first to third porous layers satisfy the relationships T2<T, T<T1, and T<T3.

The porous body according to the present invention includes the first porous layer that comes into contact with the first image and includes a first resin, a second porous layer including a second resin, and a third porous layer including a third resin that are laminated in this order. The second porous layer has a void when viewed in a thickness direction. The second resin enters pores in the first porous layer and the third porous layer so that the first to third porous layers are bonded together.

Inventors of the present invention studied that the porous body of each of Japanese Patent Application Laid-Open Nos. 2009-45851, 2005-161610 and 2001-179959 is used as a porous body in a liquid absorbing member of an ink jet recording apparatus. Consequently, a configuration in which a plurality of layers are laminated involves a problem of occurrence of a smeared image depending on the degree of bonding between the layers or a problem of insufficient conveyance strength of the liquid absorbing member during conveyance.

Through intensively studies, the inventors of the present invention found that when requirements (1) and (2) below are satisfied in the method for producing a porous body, the smeared image can be reduced, and conveyance strength can be enhanced. Requirement (1): the heating temperature T in heating the lamination of the first porous layer including the first resin, the second porous layer including the second resin, and the third porous layer including the third resin and the softening temperatures T1 to T3 of the first to third resins satisfy the relationships T2<T, T<T1, and T<T3. Requirement (2): the second porous layer has a void when viewed in a thickness direction. It was also found that the porous body obtained by the method described above satisfies requirements (3) and (4) below. Requirement (3): the second porous layer has a void when viewed in a thickness direction. Requirement (4): the second resin has entered pores in the first porous layer and the third porous layer so that the first to third porous layers are bonded together, that is, the first porous layer and the second porous layer are bonded together and the second porous layer and the third porous layer are bonded together.

Detailed mechanisms of obtaining advantages by satisfying the requirements (1) and (2) or the requirements (3) and (4) have not been identified yet. It is, however, estimated that the above advantages are obtained by the following mechanism. When the requirements (1) and (2) are satisfied, only the second porous layer is melted with its pores being maintained when heated so that the first to third porous layers are bonded together. At this time, as mentioned in the requirement (3) above, since the second porous layer has a void when viewed in the thickness direction, air permeability is maintained. In addition, as mentioned in the requirement (4) above, since the second resin has entered pores in the first porous layer and the third porous layer, the first to third porous layers are bonded together so that adhesive strength between the layers is enhanced. Thus, the interfaces between the first to third porous layers have appropriate contact areas with the air permeability maintained so that sufficient adhesion strength can be obtained. In this manner, conveyance strength can be enhanced while reducing the smeared image. As the air permeability increases, the smeared image is more reduced. In addition, as the adhesion strength between the layers increases, the conveyance strength more increases. The adhesion strength can be obtained by measuring the force for destructing a porous body in a thickness direction with, for example, FSR-1000 (trade name, manufactured by RHESCA Co., LTD.).

Figure 6:
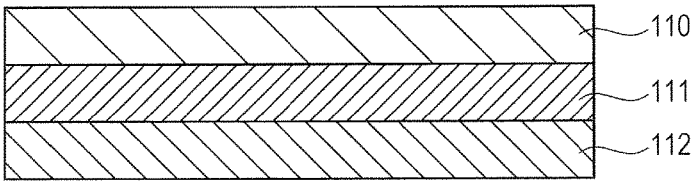
FIG. 6 is a cross-sectional view illustrating an example of a porous body according to the present invention.

FIG. 6 illustrates an example of the porous body according to the present invention. The porous body illustrated in FIG. 6 includes a first porous layer 110 that comes into contact with a first image, a second porous layer 111, and a third porous layer 112. The first, second, and third porous layers 110, 111, and 112 are arranged in this order. Another layer is laminated on a surface of the third porous layer 112 opposite to the second porous layer 111.

Regarding the air permeability of the porous body, a Gurley value measured with a Gurley densometer defined in JIS P8117 is preferably 12.0 seconds or less, more preferably 10.0 seconds or less, and much more preferably 8.0 seconds or less. A smaller Gurley value represents a higher air permeability. From the viewpoint of obtaining a uniformly high air permeability, the thickness of the porous body is preferably small, and may be 20 to 100 μm, for example. The porous body is not limited to a specific shape, and may have a roller shape or a belt shape, for example.

First Porous Layer

The first porous layer is a porous layer that includes a first resin and directly contacts with a first image to absorb at least a part of the first liquid. The first resin is not specifically limited, and is preferably fluororesin having a low surface free energy, from the viewpoint of reducing coloring material adhesion and enhancing cleaning performance. That is, the first porous layer preferably includes fluororesin, and is more preferably made of fluororesin. Specific examples of the fluororesin include polytetrafluoroethylene (PTFE), polychlorotrifluoroethylene (PCTFE), polyvinylidene fluoride (PVDF), polyvinyl fluoride (PVF), perfluoro-alkoxy-fluoro resin (PFA), tetrafluoroethylene-hexafluoropropylene copolymer (FEP), ethylene-tetrafluoroethylene copolymer (ETFE), and ethylene-chlorotrifluoroethylene copolymer (ECTFE). In addition to the fluororesins, polyamides such as polyolefin (e.g., polyethylene (PE), polypropylene (PP)), polyacrylonitrile, polyurethane, and nylon, polyester (e.g., polyethylene terephthalate (PET)), polysulfone (PSF), polymethyl methacrylate, polylactic acid, and polystyrene, for example, may be used. One or more of these materials may be used as necessary. The first porous layer may have a configuration in which a plurality of films of different materials are laminated.

From the viewpoint of satisfying the relationship ($T<T1$) with the heating temperature T (° C.), the softening temperature T1 (° C.) of the first resin is preferably 130° C. or more, more preferably 200° C. or more, and much more preferably 300° C. or more. The upper limit of the range of the temperature T1 is not specifically limited, and can be 360° C. or less, for example. The softening temperature herein refers to a melting point in a case where the resin has a melting point, and refers to a glass transition point in a case where the resin does not have a melting point but has a glass transition point. In a case where a plurality of resins are mixed, the softening temperature herein refers to a softening temperature of a resin having the largest volume among the resins. The softening temperature is a value measured by differential scanning calorimetry (DSC).

From the viewpoint of reducing coloring material adhesion in pressure contact with the first image, the average pore size in a surface of the first porous layer to come in contact with the first image is preferably 10.0 μm or less, more preferably 1.0 μm or less, and much more preferably 0.2 μm or less. In particular, when the average pore size is 0.2 μm or less, filtration ability is enhanced so that coloring material adhesion to the porous body can be significantly reduced. The average pore size herein refers to an average value of diameters of equivalent circles the areas of which are respectively equivalent to the areas of 20 or more pores in the surface of a porous layer observed with an electron microscope. The lower limit of the range of the average pore size is not specifically limited, and can be 0.02 μm or more, for example.

The thickness of the first porous layer is preferably 40 μm or less, more preferably 20 μm or less, and much more preferably 10 μm or less. When the thickness is 40 μm or less, an increase of flow resistance can be suppressed, and the smeared image can be further reduced. The lower limit of the thickness range is not specifically limited, and the thickness may be 0.3 μm or more, for example. The thickness herein is a value obtained by calculating an average of thicknesses at arbitrary ten points measured with a non-rotating spindle type micrometer (trade name: OMV_25, manufactured by Mitutoyo Corporation).

From the viewpoint of setting the surface free energy of the first porous layer to be lower than the surface free energy of the third porous layer as described later, the surface free energy of the first porous layer is preferably 40 mN/m or less, more preferably 30 mN/m or less, and much more preferably 20 mN/m or less. The lower limit of the range of the surface free energy is not specifically limited, and can be 15 mN/m or more, for example. The surface free energy herein can be measured from a permeation rate when dropping different types of liquids having different contact angles or different surface free energies.

From the viewpoint of reducing the smeared image, the Gurley value of the first porous layer is preferably 10.0 seconds or less, more preferably 5.0 seconds or less, and much more preferably 3.0 seconds or less.

Second Porous Layer

The second porous layer is a porous layer that includes a second resin and bonds first porous layer and the third porous layer. Examples of the second resin include, but are not limited to, polyolefins (e.g., polyethylene (PE), polypropylene (PP)), polyacrylonitrile, polyurethanes, polyamides such as nylon, polyesters (e.g., polyethylene terephthalate (PET)), polysulfone (PSF), polymethyl methacrylate, polylactic acid, polystyrene, and fluororesin. These resins may be used solely, or two or more types of such resins may be used together.

The second porous layer has a void when viewed in a thickness direction. Accordingly, the second porous layer has a portion where no material is present when viewed in a thickness direction. Since the second porous layer has such a structure, pores penetrating the second porous layer in the thickness direction remain after the second porous layer are melted so that air permeability in the thickness direction can be obtained. Accordingly, the smeared image can be reduced. The second porous layer has a void when viewed in a thickness direction after formation of a porous body. It can be determined by structural analysis using CT etc. or by SEM observation whether or not the second porous layer has a void when viewed in the thickness direction.

The second porous layer preferably has a mesh shape. The "mesh shape" herein refers to a state in which a plurality of fibers in the same location in the thickness direction are in contact with each other. In this manner, higher air permeability can be obtained in the thickness direction, and the smeared image can be further reduced. It should be noted that all the fibers do not need to be in contact with each other, and it is sufficient to obtain air permeability substantially in the thickness direction. Whether the second porous layer has a mesh shape or not can be determined by structural analysis using CT etc. or by SEM observation after formation of a cross section by ion milling, FIB, etc. The second porous layer having a mesh shape may be formed by, for example, electrospinning, meltblowing, or glue transfer. The second porous layer can remain in a mesh shape after formation of a porous body.

Since the second resin enters pores of the first porous layer and the third porous layer, the first to third porous layers are bonded together. In this manner, adhesive strength between the layers is enhanced so that conveyance strength can be enhanced. In particular, when the mass of the second resin that has entered pores of the third porous layer is larger than the mass of the second resin that has entered pores of the first porous layer, conveyance strength is further enhanced. Whether the second resin has entered pores of the first porous layer and the third porous layer or not and the mass of the second resin that has entered pores can be determined by structural analysis using CT etc. or by SEM observation after formation of a cross section by ion milling, FIB, etc.

Preferably, the second porous layer includes fibers including the second resin, and the average diameter of the fibers is less than the thickness of the first porous layer and less than the thickness of the third porous layer. When the average diameter of the fibers is less than the thickness of the first porous layer and less than the thickness of the third porous layer, pore collapses of the first porous layer and the third porous layer occurring when the fibers are melted can be suppressed. In this manner, air permeability of the first porous layer and the third porous layer can be obtained, and a smeared image can be reduced. The average diameter of the fibers is preferably 1 μm or more smaller and more preferably 2 μm or more smaller than the thickness of the first porous layer. The average diameter of the fibers is preferably 10 μm or more smaller and more preferably 20 μm or more smaller than the thickness of the third porous layer. Even when a part of the fibers is melted after formation of the porous layers, if the fibers remain in a fibrous shape in the second porous layer, the second porous layer is regarded as including the fibers.

The average diameter of the fibers including the second resin is preferably 10.0 μm or less, and more preferably 6.0 μm or less. This average diameter is preferably 0.1 μm or more. The average diameter of fibers herein refers to the average of values measured at 10 or more locations with SEM observation from the surface or SEM observation after formation of a cross section by, for example, ion milling, FIB, or other techniques. In a case where a part of the fibers is melted, unmelted fibers are measured.

From the viewpoint of satisfying the relationship ($T2<T$) with the heating temperature T (° C.), the softening temperature T2 (° C.) of the second resin is preferably 150° C. or less, more preferably 140° C. or less, and much more preferably 130° C. or less. The lower limit of the range of the temperature T2 is not specifically limited, and can be 50° C. or more, for example.

From the viewpoint of enhancing air permeability, a Gurley value of the second porous layer is preferably 3.0 seconds or less, more preferably 2.0 seconds or less, and much more preferably 1.0 second or less.

Third Porous Layer

The third porous layer is a porous layer that includes a third resin and enhances rigidity of a liquid absorbing member. Examples of the third resin include, but are not limited to, polyolefins (e.g., polyethylene (PE), polypropylene (PP)), polyacrylonitrile, polyurethanes, polyamides such as nylon, polyesters (e.g., polyethylene terephthalate (PET)), polysulfone (PSF), polymethyl methacrylate, polylactic acid, polystyrene, and fluororesin. These resins may be used solely, or two or more types of such resins may be used together. From the viewpoint of rigidity, nonwoven fabric is preferably used as the third porous layer.

From the viewpoint of satisfying the relationship ($T<T3$) with the heating temperature T (° C.), the softening temperature T3 (° C.) of the third resin is preferably 150° C. or more, more preferably 155° C. or more, and much more preferably 160° C. or more. The upper limit of the range of the temperature T3 is not specifically limited, and can be 360° C. or less, for example.

From the viewpoint of rigidity, the thickness of the third porous layer is preferably larger than the thickness of the first porous layer. The thickness of the third porous layer is preferably 10 μm or more larger and more preferably 20 μm or more larger than the thickness of the first porous layer. If the thickness of the third porous layer is larger than the thickness of the first porous layer, the surface free energy of the third porous layer is preferably higher than the surface free energy of the first porous layer. In this case, a larger amount of the second resin enters the third porous layer than the first porous layer, and thus, flow resistance can be reduced. The surface free energy of the third porous layer is preferably 5 mN/m or more higher and more preferably 10 mN/m or more higher than the surface free energy of the first porous layer.

From the viewpoint of rigidity, the thickness of the third porous layer is preferably 10 μm or more, more preferably 20 μm or more, and much more preferably 30 μm or more. The upper limit of the thickness range is not specifically limited, and can be 90 μm or less, for example. From the viewpoint of setting the surface free energy of the third porous layer to be higher than the surface free energy of the first porous layer, the surface free energy of the third porous layer is preferably 15 mN/m or more, more preferably 20 mN/m or more, and much more preferably 25 mN/m or more. The upper limit of the range of the surface free energy is not specifically limited, and can be 60 mN/m or less, for example.

From the viewpoint of enhancing air permeability, the Gurley value of the third porous layer is preferably 2.0 seconds or less, more preferably 1.0 seconds or less, and much more preferably 0.5 seconds or less.

Heating Process

In a method for producing a porous body according to the present invention, the heating temperature T (° C.) in heating the laminated first to third porous layers satisfies the relationships $T2<T$, $T<T1$, and $T<T3$. In this manner, only the second resin of the second porous layer can be melted when heated so that the second resin can be caused to enter pores of the first porous layer and the third porous layer. Accordingly, the layers are bonded together with a high adhesive strength so that conveyance strength can be enhanced. It is preferable to satisfy the relationships $T1-T\geq 10°$ C., $T3-T\geq 10°$ C., and $T-T2\geq 10°$ C., and more preferable to satisfy the relationships $T1-T\geq 15°$ C., $T3-T\geq 15°$ C., and $T-T2\geq 15°$ C.

In a case where the thickness of the third porous layer is larger than the thickness of the first porous layer, a heating temperature of the third porous layer is preferably higher than a heating temperature of the first porous layer. In this case, a larger amount of the second resin enters the third porous layer than the first porous layer, and thus, flow resistance can be reduced. The heating temperature of the third porous layer is preferably 5° C. or more higher and more preferably 10° C. or more higher than the heating temperature of the first porous layer. In a case where the heating temperature of the first porous layer is different from the heating temperature of the third porous layer, the heating temperatures of the first porous layer and the third porous layer satisfy the relationships $T2<T$, $T<T1$, and $T<T3$.

The heating method is preferably a lamination method using heat and pressure in which the laminated first to third porous layers are heated and pressed while being sandwiched between two heated rolls. For example, when the temperature of the roll near the third porous layer is set higher than the temperature of the roll near the first porous layer, the heating temperature of the third porous layer can be made higher than the heating temperature of the first porous layer.

A specific embodiment of an ink jet recording apparatus according to the present invention will now be described.

Examples of an ink jet recording apparatus according to the present invention include an ink jet recording apparatus that forms a first image on a transfer body as an ink receiving medium and transfers, onto the ink receiving medium, a second image after a liquid absorbing member has absorbed the first liquid, and an ink jet recording apparatus that forms a first image on an ink receiving medium as a recording medium. In the present invention, the former ink jet recording apparatus will be hereinafter referred to as a transfer type ink jet recording apparatus for convenience of description, and the latter ink jet recording apparatus will be hereinafter referred to as a direct drawing type ink jet recording apparatus for convenience of description.

The ink jet recording apparatuses will now be described.

Transfer Type Ink Jet Recording Apparatus

FIG. 1 schematically illustrates an example configuration of a transfer type ink jet recording apparatus according to an embodiment of the invention.

A transfer type ink jet recording apparatus 100 includes a transfer body 101 that temporarily holds a first image and a second image that has absorbed at least a part of the first liquid from the first image. The transfer type ink jet recording apparatus 100 also includes a transfer unit including a pressing member 106 for transfer (hereinafter referred to as a transfer pressing member) that transfers the second image onto a recording medium 108 on which an image is to be formed, that is, a recording medium for forming a final image in accordance with an intended application.

The transfer type ink jet recording apparatus 100 according to the present invention includes: the transfer body 101 supported by a support member 102; a reaction liquid applying device 103 configured to apply a reaction liquid onto the transfer body 101; an ink applying device 104 configured to apply an ink onto the transfer body 101 provided with the reaction liquid to form an ink image (first image) on the transfer body 101; a liquid absorbing device 105 configured to absorb a liquid component from the first image on the transfer body 101; and the transfer pressing member 106 configured to transfer the second image on the transfer body 101 from which the liquid component has been removed onto the recording medium 108 such as paper by pressing the recording medium. The transfer type ink jet recording apparatus 100 may further include a transfer body cleaning member 109 configured to clean a surface of the transfer body 101 after the second image has been transferred to the recording medium, as necessary.

A support member 102 rotates about a rotation axis 102*a* in a direction indicated by the arrow A in FIG. 1. The rotation of the support member 102 causes the transfer body 101 to move in the direction indicated by the arrow A. Onto the moving transfer body 101, the reaction liquid and the ink are sequentially applied by the reaction liquid applying device 103 and the ink applying device 104, respectively, thereby forming a first image on the transfer body 101. The movement of the transfer body 101 causes the first image formed on the transfer body 101 to move to a location at which the first image contacts with a liquid absorbing member 105*a* of the liquid absorbing device 105.

The liquid absorbing member 105*a* of the liquid absorbing device 105 rotates in synchronization with rotation of the transfer body 101. The first image formed on the transfer body 101 comes into contact with the moving liquid absorbing member 105*a*. While the first image is in contact with the liquid absorbing member 105*a*, the liquid absorbing member 105*a* removes liquid components from the first image.

Through the contact with the liquid absorbing member 105*a*, the liquid components included in the first image is removed. In this contacting state, the liquid absorbing member 105*a* is preferably pressed by the first image under a predetermined pressing force, so that the liquid absorbing member 105*a* effectively functions.

The removal of the liquid components can be expressed from a different point view as concentrating the ink constituting the first image formed on the transfer body. Concentrating the ink means that the proportion of the solid content contained in the ink, such as a cooling material and a resin, with respect to the liquid component contained in the ink increases owing to reduction in the liquid component.

Then, movement of the transfer body 101 causes the second image after the liquid component has been removed to move to a transfer part in which the second image contacts with the recording medium 108 to be conveyed by a recording medium conveying device 107. While the second image from which the liquid component has been removed is in contact with the recording medium 108, the pressing member 106 presses the recording medium 108, thereby forming an ink image on the recording medium 108. The ink image transferred onto the recording medium 108 is a reverse image of the second image. In the following description, this transferred ink image will also be referred to as a third image in addition to the first image (ink image before liquid removal) and the second image (ink image after liquid removal).

Since the first image is formed on the transfer body by applying the reaction liquid and then the ink, the reaction liquid that has not reacted with the ink remains on a non-image region (non-ink image region). In this apparatus, the liquid absorbing member 105*a* contacts (makes pressure contact) not only with the first image but also with an unreacted part of the reaction liquid, and liquid components of the reaction liquid is also removed from the surface of the transfer body 101.

Thus, the expression of removal of the liquid components from the first image in the above description does not strictly mean that the liquid components are removed only from the first image but means that it is sufficient to remove the liquid components at least from the first image on the transfer body. For example, liquid components in the reaction liquid applied onto a region outside the first image may be removed together with the liquid components in the first image.

The liquid component is not specifically limited as long as the liquid component does not have unchanged certain shape and has fluidity and a substantially constant volume. Examples of the liquid component include water and an organic solvent included in the ink or the reaction liquid.

In a case where the clear ink is included in the first image, the ink can also be concentrated by a liquid absorbing process. For example, in a case where the clear ink is applied onto that color ink applied on the transfer body 101 which includes a coloring material, the clear ink is present over the entire surface of the first image or the clear ink is partially present at a position or a plurality of positions on the surface of the first image, and the color ink is present on the other positions of the surface of the first image. At the position of the first image where the clear ink is present over the color ink, the porous body absorbs liquid components of the clear ink on the surface of the first image, and thus the liquid components of the clear ink moves. Accordingly, liquid components in the color ink move to the porous body so that aqueous liquid components in the color ink are absorbed. On the other hand, at a position where both a region of the clear ink and a region of the color ink are present on the surface of the first image, liquid components of the color ink and the clear ink move to the porous body so that aqueous liquid components are absorbed. The clear ink may include a large amount of components for enhancing transferability of an image from the transfer body 101 to the recording medium. For example, the clear ink may include a large amount of a component whose adhesiveness to the recording medium is higher than adhesiveness of the color ink when heated.

A configuration of the transfer type ink jet recording apparatus according to this embodiment will be described below.

Transfer Body

The transfer body 101 includes a surface layer including an image forming surface. As a material for the surface layer, various materials such as resin and ceramic may be used as necessary, and a material having a high compressive elastic modulus is preferably used because of, for example, durability. Specific examples of the material include acrylic resin, acrylic silicone resin, fluorine-containing resin, and condensates obtainable by condensing a hydrolyzable organic silicon compound. To enhance wettability and transferability of the reaction liquid, the surface layer may be subjected to a surface treatment. Examples of the surface treatment include a frame treatment, a corona treatment, a plasma treatment, a polishing treatment, a roughening treatment, an activation energy ray irradiation treatment, an ozone treatment, a surfactant treatment, and a silane coupling treatment. Two or more of these treatments may be combined. The surface layer may be provided with any optional surface shape.

The transfer body preferably includes a compressible layer having a function of absorbing a pressure fluctuation. In the presence of the compressible layer, the compressible layer absorbs deformation, local pressure fluctuations are dispersed so that excellent transferability can be maintained even in high-speed printing. Examples of a material for the compressible layer include acrylonitrile-butadiene rubber, acrylic rubber, chloroprene rubber, urethane rubber, and silicone rubber. In molding the rubber material, a predetermined amount of, for example, a vulcanizing agent and a vulcanization accelerator may be added, and a foaming agent and a filler such as hollow fine particles or common salt may be optionally added as necessary to form a porous product. In this manner, when various pressure fluctuations occur, air bubbles are compressed with their volumes changed. Thus, deformation in any direction except the compressed direction is small, which can provide more stable transferability and durability. Some porous rubber materials have a continuous porous structure in which pores communicate with each other, and other porous rubber materials have an independent porous structure in which pores are independently present. In the present invention, either of the structures may be employed, or both of the structures may be employed in combination.

The transfer body preferably includes an elastic layer between the surface layer and the compressible layer. As a material for the elastic layer, resin, ceramic, or other materials may be used, as necessary. In terms of processing properties, various elastomer materials and rubber materials are preferably used. Specific examples of the material include fluoro silicone rubber, phenyl silicone rubber, fluororubber, chloroprene rubber, urethane rubber, nitrile rubber, ethylene propylene rubber, natural rubber, styrene rubber, isoprene rubber, butadiene rubber, ethylene/propylene/butadiene terpolymers, and nitrile butadiene rubber. In particular, silicone rubber, fluoro silicone rubber, and phenyl silicone rubber are preferably used in terms of dimensional stability and durability because these materials have low permanent strain. These materials are also preferable in terms of transferability because a change in elastic modulus with temperature is small.

Between layers (surface layer, elastic layer, compressible layer) constituting the transfer body, various adhesives or a double face tape may be used for fixing and holding these layers. A reinforcing layer having a high compressive elastic modulus may be provided to reduce lateral extension caused when installed in an apparatus and to retain the elasticity. The reinforcing layer may be a woven fabric. The transfer body may be produced by using any combination of layers of the materials described above.

The size of the transfer body may be freely selected depending on an intended size of a printed image. The transfer body is not limited to a specific shape, and may have a sheet shape, a roller shape, a belt shape, or an endless web shape, for example.

Support Member

The transfer body 101 is supported on the support member 102. As a method for supporting the transfer body, various adhesives or a double face tape may be used. The transfer body may be supported on the support member 102 by using an installation member of, for example, metal, ceramic, or resin attached to the transfer body.

The support member 102 needs to have a structural strength to some degree from the viewpoints of conveyance accuracy and durability. The support member is preferably made of metal, ceramic, or resin, for example. In particular, to enhance responsiveness of control by reducing an inertia during operation in addition to rigidity against pressurization in transfer and dimensional accuracy, aluminium, iron, stainless, acetal resin, epoxy resin, polyimide, polyethylene, polyethylene terephthalate, nylon, polyurethane, silica ceramic, or alumina ceramic is preferably used. Two or more of these materials are also preferably used in combination.

Reaction Liquid Applying Device

The ink jet recording apparatus according to this embodiment includes a reaction liquid applying device 103 configured to apply a reaction liquid onto the transfer body 101. The reaction liquid applying device 103 illustrated in FIG.

1 is a gravure offset roller including a reaction liquid storage part 103*a* configured to store a reaction liquid and reaction liquid applying members 103*b* and 103*c* configured to apply reaction liquid in the reaction liquid storing part 103*a* onto the transfer body 101.

Ink Applying Device

The ink jet recording apparatus according to this embodiment includes an ink applying device 104 configured to apply an ink onto the transfer body 101 onto which a reaction liquid is applied. The reaction liquid and the ink are mixed to form a first image, and a liquid component in the first image is absorbed in the liquid absorbing device 105 described below.

Liquid Absorbing Device

In this embodiment, the liquid absorbing device 105 includes the liquid absorbing member 105*a* and the pressing member 105*b* to press the liquid absorbing member 105*a* against the first image on the transfer body 101. The liquid absorbing member 105*a* for liquid absorption and the pressing member 105*b* are not limited to specific shapes. For example, as illustrated in FIG. 1, the liquid absorbing device 105 may have a configuration in which the pressing member 105*b* has a cylindrical shape and the liquid absorbing member 105*a* has a belt shape so that the cylindrical pressing member 105*b* presses the belt-shaped liquid absorbing member 105*a* against the transfer body 101. The liquid absorbing device 105 may also have a configuration in which the pressing member 105*b* has a cylindrical shape and the liquid absorbing member 105*a* has a tubular shape formed around the periphery of the cylindrical pressing member 105*b* so that the cylindrical pressing member 105*b* presses the tubular liquid absorbing member 105*a* against the transfer body 101.

In the present invention, in consideration of, for example, space in the ink jet recording apparatus, the liquid absorbing member 105*a* preferably has a belt shape.

The liquid absorbing device 105 including the liquid absorbing member 105*a* having such a belt shape may include a stretching member to stretch the liquid absorbing member 105*a*. In FIG. 1, reference characters 105*c*, 105*d*, and 105*e* denote stretching rollers serving as stretching members. In FIG. 1, the pressing member 105*b* is a roller member that rotates in a manner similar to the stretching rollers, but the pressing member 105*b* is not limited to such a roller member.

The liquid absorbing device 105 includes the liquid absorbing member 105*a* including a porous body and the pressing member 105*b* for liquid absorption that presses the liquid absorbing member 105*a* against the first image on the transfer body 101. When the liquid absorbing member 105*a* is brought into contact with the first image by the pressing member 105*b*, liquid components included in the first image are absorbed in the liquid absorbing member 105*a* so that a second image is obtained by reducing the liquid components of the first image. As a method for reducing the liquid components in the first image, in addition to the method of causing the liquid absorbing member to make pressure contact as described here, various known methods, such as a method using heating, a method of sending low-humidity air, and a method of reducing pressure, for example, may be used in combination. These methods may be applied to the second image with reduced liquid components to further reduce the liquid components.

Requirements and configurations in the liquid absorbing device 105 will be described in detail.

Pretreatment

In this embodiment, before the liquid absorbing member 105*a* including the porous body is brought into contact with the first image, a pretreatment is preferably performed with a pretreatment apparatus (not shown in FIGS. 1 and 2) that applies wetting liquid (hereinafter also referred to as a treatment solution) to the liquid absorbing member. The wetting liquid used in the present invention preferably includes water and a water-soluble organic solvent. Water used in this case is preferably water deionized by, for example, ion exchange. The water-soluble organic solvent is not specifically limited, and any known organic solvent such as ethanol or isopropyl alcohol may be used. The pretreatment of the liquid absorbing member used in the present invention is not limited to a specific liquid application method, and immersion or dropping of droplets is preferably employed. Although the component to adjust the surface tension of the wetting liquid is not specifically limited, a surfactant is preferably used as the component. As the surfactant, at least one of a silicone-based surfactant and a fluorinated surfactant is preferably used, and use of a fluorinated surfactant is more preferable. The content of the surfactant in the wetting liquid is preferably 0.2 mass % or more, more preferably 0.4 mass % or more, and particularly preferably 0.5 mass % or more, based on the total mass of the wetting liquid. Although the upper limit of the content of the surfactant in the wetting liquid is not specifically limited, the upper limit is preferably 10 mass % of the total mass of the wetting liquid from the point of view of the solubility of the surfactant in the wetting liquid.

Pressing Condition

The pressure of the liquid absorbing member pressed against the first image on the transfer body is preferably 2.9 $N/cm^2$ (0.3 $kgf/cm^2$) or more, because in this pressure range a liquid component in the first image can be separated from a solid component more quickly and the liquid component can be reduced from the first image. The pressure is preferably 98 $N/cm^2$ (10 $kgf/cm^2$) or less, because in this pressure range a structural load on the apparatus can be reduced. The pressure of the liquid absorbing member herein refers to a nip pressure between the ink receiving medium and the liquid absorbing member, and calculated by performing a surface pressure measurement with a surface pressure distribution measuring device (trade name: I-SCAN, manufactured by Nitta Corporation) and dividing the weight in the pressed region by the area.

Application Time

The application time during which the liquid absorbing member 105*a* is in contact with the first image is preferably 50 ms (milliseconds) or less in order to further reducing adhesion of a coloring material in the first image to the liquid absorbing member. The application time herein is calculated by dividing a pressure sensing width in the direction in which the ink receiving medium moves by a travelling speed of the ink receiving medium in the surface pressure measurement described above. This application time will be hereinafter referred to as a liquid absorbing nip time.

In this manner, the liquid components in the first image are absorbed so that a second image with reduced liquid components is formed on the transfer body 101. The second image is then transferred onto the recording medium 108 in the transfer part. The apparatus configuration and requirements in the transfer will be described.

Transfer Pressing Member

In this embodiment, while the second image is in contact with the recording medium 108 being conveyed by the recording medium conveying device 107, the transfer pressing member 106 presses the recording medium 108 so that an ink image is transferred onto the recording medium 108. The transfer onto the recording medium 108 after removal of the liquid component included in the first image on the transfer body 101 can obtain a recorded image in which curling, cockling and the like are reduced.

The pressing member 106 needs to have a structural strength to some degree from the viewpoints of conveyance accuracy and durability of the recording medium 108. The pressing member 106 is preferably made of metal, ceramic, or resin, for example. In particular, to enhance responsiveness of control by reducing an inertia during operation in addition to rigidity against pressurization in transfer and dimensional accuracy, aluminium, iron, stainless, acetal resin, epoxy resin, polyimide, polyethylene, polyethylene terephthalate, nylon, polyurethane, silica ceramic, or alumina ceramic is preferably used. Two or more of these materials may be used in combination.

The time during which the pressing member 106 presses the recording medium 108 in order to transfer the second image on the transfer body 101 onto the recording medium 108 is not specifically limited, and is preferably 5 ms (milliseconds) or more to 100 ms (milliseconds) or less in order to perform transfer appropriately and prevent impairing of durability of the transfer body. The time of pressing herein refers to a time during which the recording medium 108 is in contact with the transfer body 101, and is calculated by performing a surface pressure measurement with a surface pressure distribution measuring device (trade name: I-SCAN, manufactured by Nitta Corporation) and dividing the length in the conveyance direction of a pressurization region by the conveyance speed.

The pressure with which the pressing member 106 presses the recording medium 108 in order to transfer the second image on the transfer body 101 onto the recording medium 108 is not specifically limited as long as the transfer is appropriately performed and durability of the transfer body is not impaired. To satisfy these requirements, the pressure is preferably 9.8 $N/cm^2$ (1 $kg/cm^2$) or more to 294.2 $N/cm^2$ (30 $kg/cm^2$) or less. The pressure in this embodiment refers to a nip pressure between the recording medium 108 and the transfer body 101, and is calculated by performing a surface pressure measurement with a surface pressure distribution measuring device and dividing the weight in a pressurization region by the area.

The temperature at which the pressing member 106 presses the recording medium 108 in order to transfer the second image on the transfer body 101 onto the recording medium 108 is not specifically limited and is preferably greater than or equal to a glass transition point or a softening point of a resin component included in the ink. Heating is preferably performed with a heating device configured to heat the second image on the transfer body 101 and the recording medium 108.

The pressing member 106 is not limited to a specific shape, and may be a roller shape, for example.

Recording Medium and Recording Medium Conveying Device

In this embodiment, the recording medium 108 is not specifically limited, and any known recording medium may be used. Examples of the recording medium include a rolled long medium and a cut-sheet medium cut into a predetermined size. Examples of a material for the recording medium include paper, a plastic film, a wooden board, a corrugated cardboard, and a metal film.

In FIG. 1, the recording medium conveying device 107 for conveying the recording medium 108 includes a recording medium feeding roller 107*a* and a recording medium winding roller 107*b*. The recording medium conveying device 107 only needs to convey the recording medium, and is not limited to this configuration.

Control System

Figure 3:
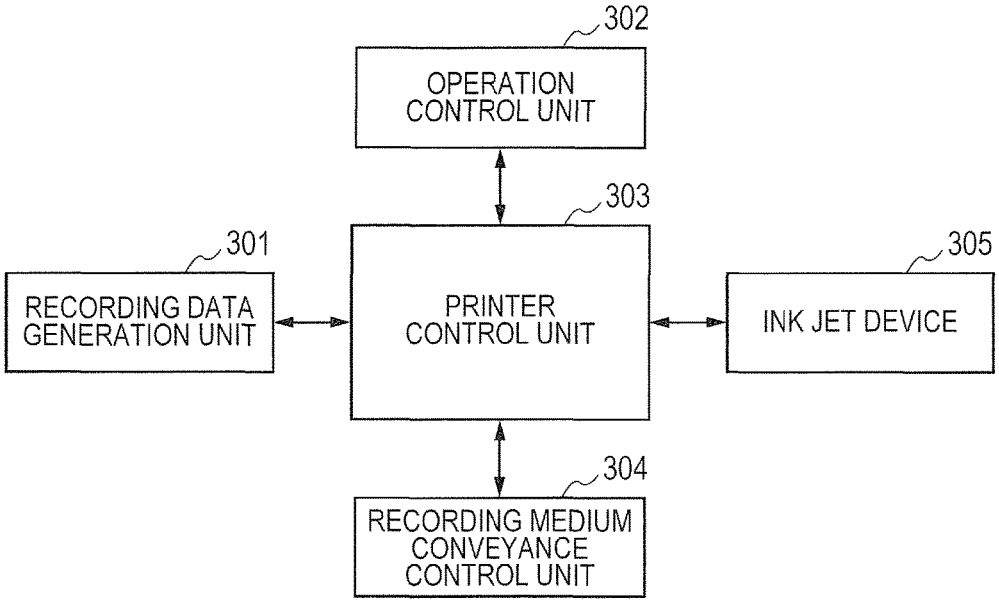
FIG. 3 is a block diagram illustrating a control system of the entire ink jet recording apparatus illustrated in FIGS. 1 and 2.

The transfer type ink jet recording apparatus according to this embodiment includes a control system that controls devices. FIG. 3 is a block diagram illustrating a control system of the entire transfer type ink jet recording apparatus illustrated in FIG. 1.

In FIG. 3, reference numeral 301 denotes a recording data generating unit such as an external print server, reference numeral 302 denotes an operation control unit such as an operation panel, reference numeral 303 denotes a printer control unit to perform a recording process, reference numeral 304 denotes a recording medium conveyance control unit to convey a recording medium, and reference numeral 305 denotes an ink jet device to perform printing.

Figure 4:
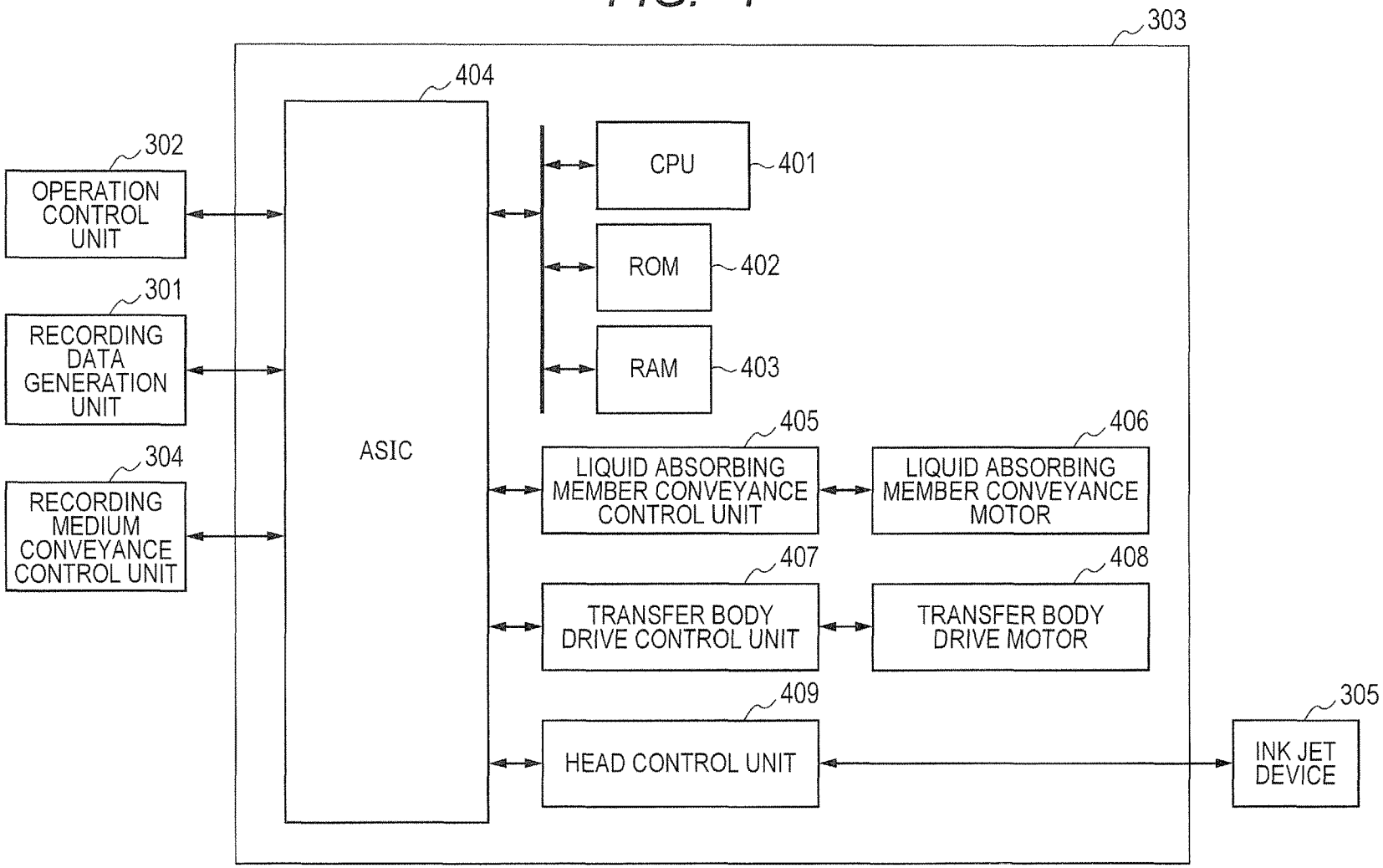
FIG. 4 is a block diagram of a printer control unit in the transfer type ink jet recording apparatus illustrated in FIG. 1.

FIG. 4 is a block diagram of a printer control unit in the transfer type ink jet recording apparatus illustrated in FIG. 1.

Reference numeral 401 denotes a CPU to control the entire printer, reference numeral 402 denotes a ROM to store a control program of the CPU, and reference numeral 403 denotes a RAM to execute a program. Reference numeral 404 denotes an application specific integrated circuit (ASIC) incorporating a network controller, a serial IF controller, a head data generating controller, and a motor controller, for example. Reference numeral 405 denotes a liquid absorbing member conveyance control unit to drive a liquid absorbing member conveyance motor 406, and is subjected to command control by the ASIC 404 through a serial IF. Reference numeral 407 denotes a transfer body drive control unit to drive a transfer body drive motor 408, and is subjected to command control by the ASIC 404 through the serial IF similarly. Reference numeral 409 denotes a head control unit to generate final discharge data of the ink jet device 305 and to generate a driving voltage, for example.

Direct Drawing Type Ink Jet Recording Apparatus

As another embodiment of the present invention, a direct drawing type ink jet recording apparatus will be described. In the direct drawing type ink jet recording apparatus, an ink receiving medium is a recording medium on which an image is to be formed thereon.

Figure 2:
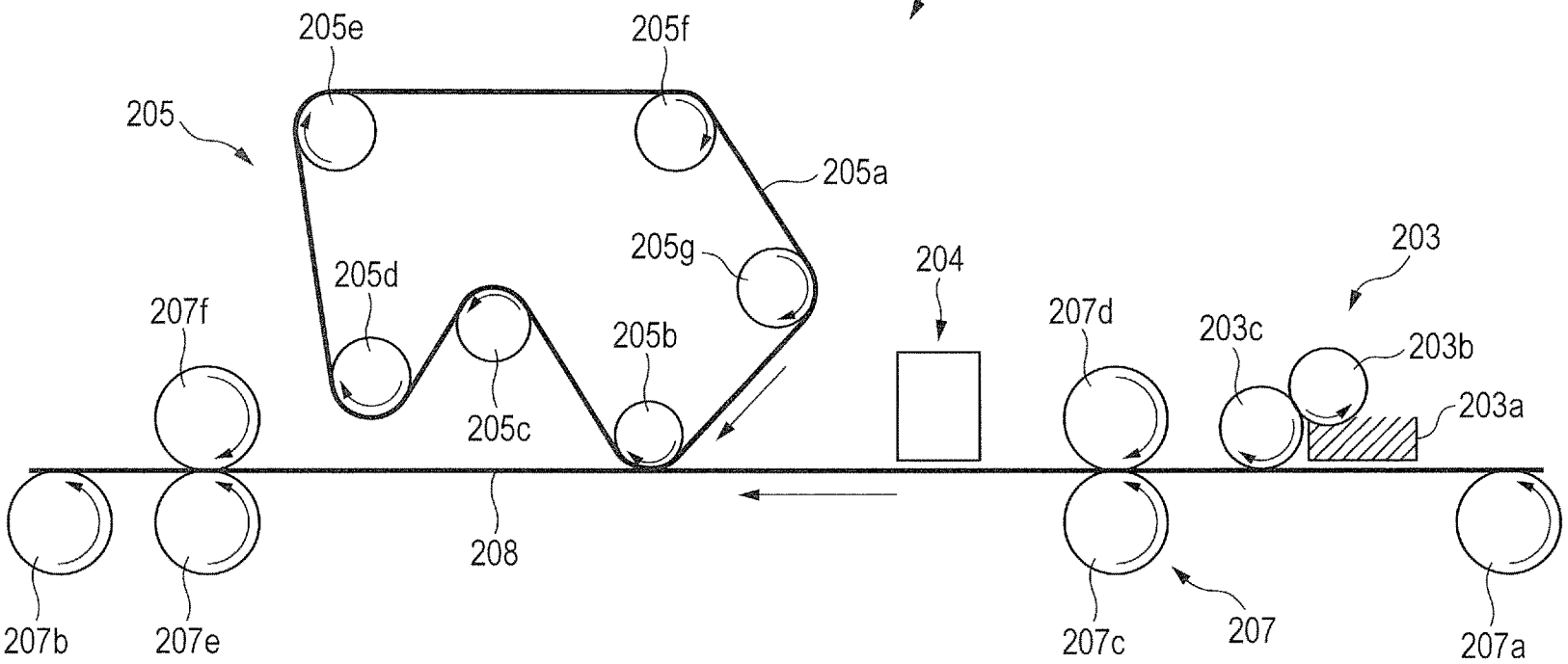
FIG. 2 schematically illustrates an example configuration of a direct drawing type ink jet recording apparatus according to an embodiment of the present invention.

FIG. 2 schematically illustrates an example configuration of a direct drawing type ink jet recording apparatus 200 according to this embodiment. As compared to the transfer type ink jet recording apparatus described above, the direct drawing type ink jet recording apparatus includes members similar to those of the transfer type ink jet recording apparatus except that direct drawing type ink jet recording apparatus does not include any of the transfer body 101, the support member 102, and the transfer body cleaning member 109 and forms an image on a recording medium 208.

Thus, a reaction liquid applying device 203 configured to apply a reaction liquid onto the recording medium 208, an ink applying device 204 configured to apply an ink onto the recording medium 208, and a liquid absorbing device 205 configured to absorb liquid components included in a first image by using a liquid absorbing member 205*a* that comes into contact with the first image on the recording medium 208 each have a configuration similar to that of the transfer type ink jet recording apparatus, and thus description thereof will not be repeated.

In the direct drawing type ink jet recording apparatus according to this embodiment, the liquid absorbing device 205 includes the liquid absorbing member 205*a* and a pressing member 205*b* for liquid absorption that presses the liquid absorbing member 205*a* against the first image on the recording medium 208. The liquid absorbing member 205*a* and the pressing member 205*b* are not limited to specific shapes, and may have similar shapes to those of a liquid absorbing member and a pressing member that can be used in the transfer type ink jet recording apparatus. The liquid absorbing device 205 may include a stretching member to stretch the liquid absorbing member. In FIG. 2, reference characters 205*c*, 205*d*, 205*e*, 205*f*, and 205*g* denote extending rollers serving as stretching members. The number of stretching rollers is not limited to five in FIG. 2, and may be any necessary number depending on apparatus design. There may be provided an ink applying unit configured to apply an ink onto the recording medium 208 by the ink applying device 204, and may be provided an unillustrated recording medium support member configured to support the bottom of the recording medium at a location opposite to a liquid component removing unit configured to cause the liquid absorbing member 205*a* to make pressure contact with the first image on the recording medium to remove liquid components.

Recording Medium Conveying Device

In the direct drawing type ink jet recording apparatus according to this embodiment, the recording medium conveying device 207 is not specifically limited, and may be a known conveying device in a direct drawing type ink jet recording apparatus. For example, as illustrated in FIG. 2, a recording medium conveying device including a recording medium feeding roller 207*a*, a recording medium winding roller 207*b*, and recording medium conveying rollers 207*c*, 207*d*, 207*e*, and 207*f* may be used.

Control System

The direct drawing type ink jet recording apparatus according to this embodiment includes a control system to control devices. FIG. 3 illustrates a block diagram of the control system of the entire direct drawing type ink jet recording apparatus illustrated in FIG. 2, similar to the transfer type ink jet recording apparatus illustrated in FIG. 1.

Figure 5:
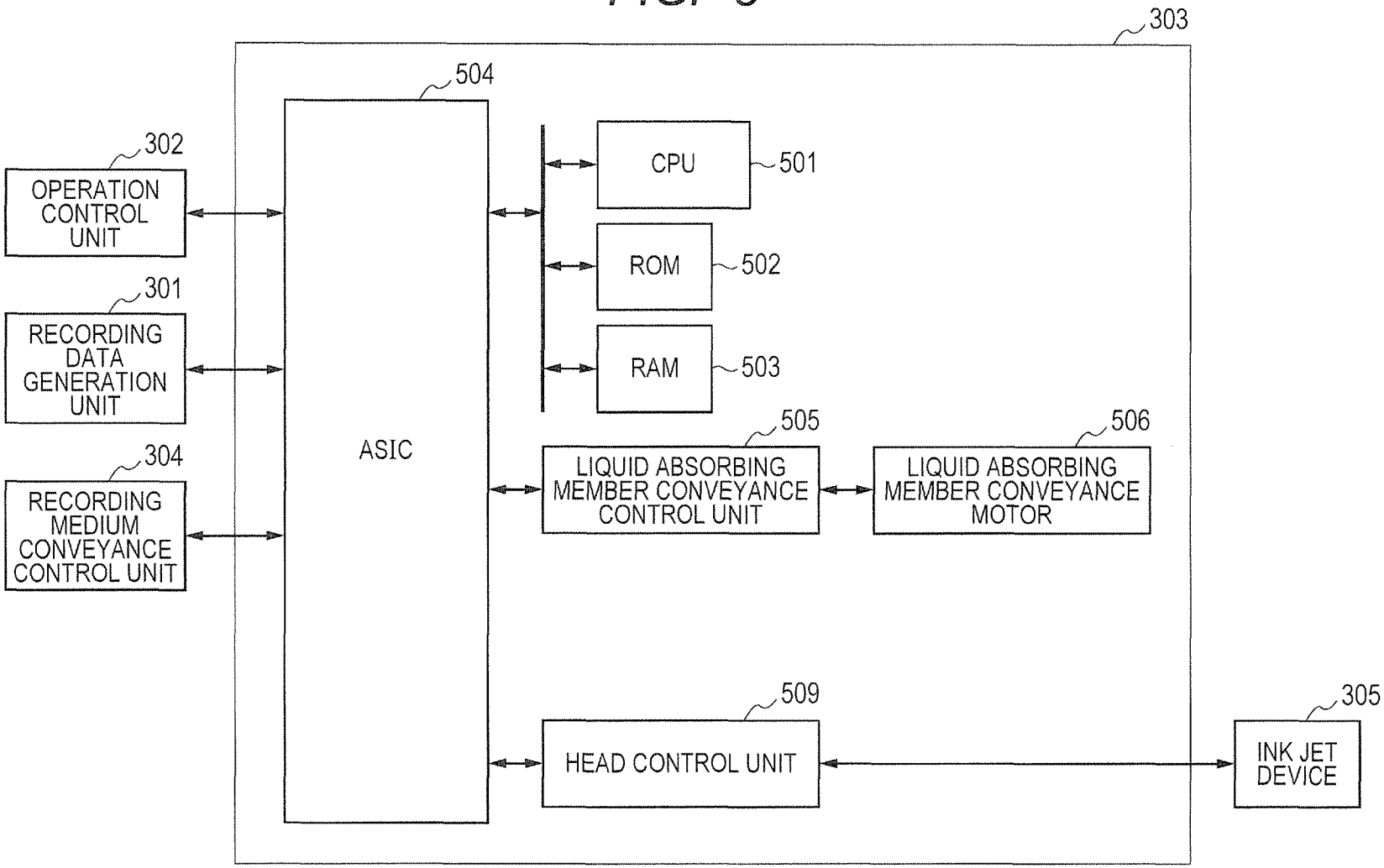
FIG. 5 is a block diagram illustrating a printer control unit in the direct drawing type ink jet recording apparatus illustrated in FIG. 2.

FIG. 5 is a block diagram illustrating a printer control unit in the direct drawing type ink jet recording apparatus illustrated in FIG. 2. The block diagram illustrated in FIG. 5 is similar to the block diagram of the printer control unit in the transfer type ink jet recording apparatus illustrated in FIG. 4, except that the printer control unit does not include any of the transfer body drive control unit 407 and the transfer body drive motor 408.

In FIG. 5, reference numeral 501 denotes a CPU to control the entire printer, reference numeral 502 denotes a ROM to store a control program of the CPU, and reference numeral 503 denotes a RAM to execute a program. Reference numeral 504 denotes an ASIC incorporating a network controller, a serial IF controller, a head data generating controller, and a motor controller, for example. Reference numeral 505 denotes a liquid absorbing member conveyance control unit to drive a liquid absorbing member conveyance motor 506, and is subjected to command control by the ASIC 504 through a serial IF. Reference numeral 509 denotes a head control unit to generate final discharge data of the ink jet device 305 and generate a driving voltage, for example.

In an aspect of the present invention, it is possible to provide a porous body that is applicable to an ink jet recording apparatus which can reduce the smeared image and includes a liquid absorbing member having a high conveyance strength, and a method for producing the porous body. In another aspect of the present invention, an ink jet recording method using the porous body described above can be provided. In still another aspect of the present invention, an ink jet recording apparatus including the porous body described above can be provided.

EXAMPLES

The present invention will now be more specifically described with reference to examples and comparative examples. The present invention is not limited to the following examples, unless exceeding the gist thereof. In the following description of the examples, "part(s)" is based on weight unless otherwise specified.

Preparation of Reaction Liquid

The reaction liquid having the following composition was used. The indication "balance" for ion-exchanged water refers to an amount with which the sum of all the components constituting the reaction liquid is 100.0 mass %.

glutaric acid 21.0 mass % glycerin 5.0 mass % surfactant (trade name: Megafac F444, manufactured by DIC Corporation) 5.0 mass % ion-exchanged water balance

Preparation of Pigment Dispersion

First, 10 parts of carbon black (trade name: MONARCH 1100, manufactured by Cabot Corporation), 15 parts of a resin aqueous solution (a solution of a styrene-ethyl acrylate-acrylic acid terpolymer having an acid value of 150, a weight-average molecular weight (Mw) of 8,000, and a resin content of 20.0 mass % neutralized with a potassium hydroxide aqueous solution), and 75 parts of pure water were mixed. This mixture was fed in a batch type vertical sand mill (manufactured by AIMEX Co., Ltd.), and the mill was charged with 200 parts of zirconia beads having a diameter of 0.3 mm. These material were dispersed for five hours while being cooled with water. Then, this dispersion liquid was centrifugalized so that coarse particles were removed, and then, a pigment dispersion having a pigment content of 10.0 mass % was obtained.

Preparation of Resin Fine Particle Dispersion

First, 20 parts of ethyl methacrylate, 3 parts of 2,2'-azobis-(2-methylbutyronitrile), and 2 parts of n-hexadecane were mixed, and the mixture was stirred for 0.5 hours. This mixture was dropped to 75 parts of an 8 mass % aqueous solution of a styrene-butyl acrylate-acrylic acid terpolymer (having an acid value of 130 mgKOH/g, a weight-average molecular weight (Mw) of 7,000), followed by stirring for 0.5 hours. Then, the resulting mixture was subjected to supersonic wave irradiation for 3 hours with a supersonic wave irradiator. Subsequently, the mixture was subjected to a polymerization reaction for 4 hours in a nitrogen atmosphere at 80° C., followed by cooling to room temperature. The reaction product was then filtered to yield a resin particle dispersion with a resin content of 25.0 mass %.

Preparation of Ink

The pigment dispersion and the resin fine particle dispersion were mixed with the components below. The indication "balance" for ion-exchanged water refers to an amount with which the sum of all the components constituting the ink is 100.0 mass %.

pigment dispersion 40.0 mass % resin fine particle dispersion 20.0 mass % glycerine 7.0 mass % polyethylene glycol (having a number-average molecular weight (Mn) of 1,000) 3.0 mass % surfactant: Acetylenol E100 (trade name, manufactured by Kawaken Fine Chemicals Co., Ltd.) 0.5 mass % ion-exchanged water balance

These materials were sufficiently stirred to be dispersed, and then subjected to pressure filtration through a microfilter having a pore size of 3.0 μm (manufactured by Fujifilm Corporation), thereby preparing an ink.

Preparation of Porous Body

Porous layers Nos. 1 through 5 indicated in Table 1 below were prepared as a first porous layer including a first resin and a third porous layer including a third resin. Specifically, the porous layers Nos. 1 through 5 were prepared by the following method. The porous layers Nos. 1, 2, and 5 were prepared with electrospinning by applying a voltage between a nozzle and an electrode, laminating a melted melt, and then performing hot pressing thereon. The porous layer No. 3 was prepared by subjecting emulsion-polymerized particles of crystallized PTFE to compression molding and performing multi-axial stretching of the molded particles at a melting point of the PTFE or lower to obtain a fibrillated porous body. In a manner similar to that of the porous layer No. 3, the porous layer No. 4 was prepared by subjecting emulsion-polymerized particles of crystallized PP to compression molding and performing multi-axial stretching of the molded particles at a melting point of the PP or lower to obtain a fibrillated porous body.

TABLE 1

| No. | First resin or third resin | Surface free energy (mN/m) | Thickness (μm) | Softening temperature (° C.) | Average pore size (μm) | Gurley value (sec.) |
|---|---|---|---|---|---|---|
| 1 | polyethylene terephthalate | 31 | 4 | 250 | 0.2 | 2.0 |
| 2 | polyethylene terephthalate | 31 | 8 | 250 | 0.3 | 2.0 |
| 3 | polytetrafluoroethylene | 18 | 8 | 310 | 0.3 | 2.0 |
| 4 | polypropylene | 29 | 30 | 160 | 8.0 | 0.2 |
| 5 | polyethylene terephthalate | 31 | 40 | 250 | 6.5 | 0.3 |

Porous layers Nos. 6 through 12 indicated in Table 2 below were prepared as second porous layers including fibers containing the second resin. Specifically, the porous layers Nos. 6 through 12 were produced by the following method. The porous layers Nos. 6, 7, and 9 through 12 were produced with electrospinning by applying a voltage between a nozzle and an electrode, laminating a melted melt, and then performing hot pressing thereon. In producing the porous layer No. 8, Kurangile U-1485 (trade name, manufactured by Kurabo Industries Ltd.), which is a polyurethane film, was used.

TABLE 2

| No. | Second resin | Fiber average diameter (μm) | Softening temperature (° C.) | Shape | Gurley value (sec.) | Void when viewed in thickness direction |
|---|---|---|---|---|---|---|
| 6 | polyurethane | 6 | 125 | non-mesh (3D crossing) | 1.0 | present |
| 7 | polyurethane | 6 | 125 | non-mesh (3D crossing) | 1.0 | absent |
| 8 | polyurethane | 6 | 125 | film | unmeasurable | absent |
| 9 | polyurethane | 6 | 125 | mesh | 1.0 | present |
| 10 | polyurethane | 1 | 125 | mesh | 1.0 | present |
| 11 | polyamide | 2 | 190 | mesh | 0.5 | present |
| 12 | polymethyl methacrylate | 2 | 140 | mesh | 0.5 | present |

The average diameter of fibers was calculated by obtaining images of 10 locations on the surface of the porous layer with an SEM and averaging widths of fibers crossing diagonal lines of the obtained images. The softening temperature of a resin was measured from a peak value of the heat absorption obtained with a differential scanning calorimeter (DSC) (trade name: Q-1000, TA Instruments Japan K.K.). A Gurley value was measured with a Gurley densometer in conformity with JIS P8117. A non-mesh shape (3D crossing) in Table 2 refers to a state in which fibers three-dimensionally cross and are not in contact with one another.

The first, second, and third porous layers in the combinations shown in Table 3 below are laminated in this order by a lamination method using heat and pressure, thereby obtaining porous bodies of the examples and the comparative examples. The lamination method using heat and pressure was performed by sandwiching the first to third porous layers with two rollers. The roll surface temperature at the first porous layer side and the roll surface temperature at the third porous layer side are shown in Table 3. The mass of the second resin that has entered pores of the third porous layer with respect to a mass of the second resin that has entered pores of the first porous layer (mass of the second resin that has entered the third porous layer with respect to that has entered the first porous layer) was evaluated by forming a cross section of a porous body by ion milling and then observing the cross section with an SEM.

In Comparative Example 1, the second resin in the second porous layer was not melted by lamination using heat and pressure, and thus, the second resin did not enter pores of the first and third porous layers. In Comparative Example 2, not only the second resin in the second porous layer but also the third resin in the third porous layer was melted by lamination using heat and pressure. Thus, at the interface between the second porous layer and the third porous layer, the second and third porous layers did not maintain pores and the second resin and the third resin were mixed together, thereby bonding the second porous layer and the third porous layer together.

TABLE 3

| | No. | | | Heating temperature (° C.) | | Gurley value | Mass of second resin entering third porous layer |
|---|---|---|---|---|---|---|---|
| | First porous layer | Second porous layer | Third porous layer | Roll temperature at first porous layer side | Roll temperature at third porous layer side | of porous body (sec.) | with respect to that entering first porous layer |
| Example 1 | No. 1 | No. 6 | No. 4 | 155 | 155 | 9.5 | same |
| Example 2 | No. 1 | No. 9 | No. 4 | 155 | 155 | 5.8 | same |
| Example 3 | No. 2 | No. 6 | No. 4 | 155 | 155 | 5.0 | same |
| Example 4 | No. 2 | No. 6 | No. 4 | 140 | 140 | 7.5 | same |
| Example 5 | No. 2 | No. 6 | No. 4 | 127 | 137 | 4.0 | larger |
| Example 6 | No. 3 | No. 6 | No. 4 | 155 | 155 | 4.3 | larger |
| Example 7 | No. 1 | No. 10 | No. 4 | 155 | 155 | 5.5 | same |
| Example 8 | No. 3 | No. 11 | No. 5 | 230 | 230 | 3.5 | larger |
| Example 9 | No. 3 | No. 12 | No. 5 | 230 | 230 | 3.7 | larger |
| Comparative Example 1 | No. 1 | No. 6 | No. 4 | 110 | 110 | 3.8 | — |
| Comparative Example 2 | No. 1 | No. 7 | No. 4 | 180 | 180 | 25.0 | — |
| Comparative Example 3 | No. 1 | No. 8 | No. 4 | 155 | 155 | unmeasurable | same |

Ink Jet Recording Apparatus and Image Formation

The transfer type ink jet recording apparatus illustrated in FIG. 1 was used. The transfer body 101 was fixed to a surface of the support member 102 by a double face tape. A sheet in which a PET sheet with a thickness of 0.5 mm was coated with a silicone rubber (trade name: KE12, manufactured by Shin-Etsu Chemical Co., Ltd.) having a thickness of 0.3 mm was used as an elastic layer of the transfer body 101. In addition, a mixture of a condensate obtained by mixing glycidoxypropyl triethoxysilane and methyltriethoxysilane at a mole ratio of 1:1 and subjected to heat refluxing and a cationic photopolymerization initiator (trade name: SP150, manufactured by ADEKA Corporation) was prepared. An atmospheric pressure plasma treatment was performed in such a manner that the contact angle of water on the surface of the elastic layer was 10 degrees or less. Thereafter, the mixture was applied onto the elastic layer to form a film with UV irradiation (with a high-pressure mercury lamp having a cumulative exposure of 5000 mJ/cm$^2$) and heat curing (at 150° C. for 2 hours), thereby producing the transfer body 101 in which a surface layer with a thickness of 0.5 μm was formed on the elastic layer. The surface of the transfer body 101 was kept at 60° C. by an unillustrated heater.

The amount of the reaction liquid applied by the reaction liquid applying device 103 was 1 g/m$^2$. As the ink applying device 104, an ink jet recording head configured to discharge an ink in an on-demand manner with an electrothermal converter was used. The amount of the ink applied in image formation was 20 g/m$^2$.

The liquid absorbing member 105*a* had the porous body on a side that comes into contact with the first image. Before use, the liquid absorbing member 105*a* was immersed in a wetting liquid including 95 parts of ethanol and 5 parts of water so that the wetting liquid permeated the liquid absorbing member 105*a*, and then the wetting liquid was replaced with water. The pressing member 105*b* applied a pressure so that a nip pressure between the transfer body 101 and the liquid absorbing member 105*a* was 2 kg/cm$^2$ in average. The pressing member 105*b* had a diameter of 200 mm.

The conveyance speed of the liquid absorbing member 105*a* was adjusted to a speed substantially equal to a travelling speed of the transfer body 101 by the stretching rollers 105*c*, 105*d*, and 105*e* stretching the liquid absorbing member 105*a* and conveying the liquid absorbing member 105*a*. To adjust the conveyance speed substantially equal to the travelling speed of the transfer body 101, the recording medium 108 was conveyed by the recording medium feeding roller 107*a* and the recording medium winding roller 107*b*. The conveyance speed of the recording medium 108 was 0.2 m/s. As the recording medium 108, Aurora Coat (manufactured by Nippon Paper Industries Co., Ltd. with a basis weight of 104 g/m$^2$) was used.

Evaluation

The porous bodies obtained in the examples and comparative examples were evaluated by the following method. Table 4 shows evaluation results. In the present invention, evaluation criteria A and B are defined as preferred levels and criterion C is defined as an unacceptable level in evaluation items below.

Conveyance Strength

It was observed whether deformation occurred or not due to a tension in conveyance of the liquid absorbing member 105*a* in the image formation. Evaluation criteria are as follows:

A: Plastic deformation was not observed and was not observed even with a higher tension in high-speed conveyance.

B: Plastic deformation was not observed.

C: Plastic deformation was observed.

Smeared Image

The amount of movement of a coloring material, that is, the smeared image, after absorption of a first image in the image formation was observed. Evaluation criteria are as follows:

A: No smeared image was observed even after repetitive use.

B: A slight smeared image was observed but at a negligible level.

C: A conspicuous smeared image was observed.

TABLE 4

| | Evaluation result | |
|---|---|---|
| | conveyance strength | Smeared image |
| Example 1 | B | B |
| Example 2 | B | A |
| Example 3 | B | A |
| Example 4 | B | A |
| Example 5 | B | A |
| Example 6 | B | A |
| Example 7 | B | A |
| Example 8 | A | A |
| Example 9 | A | A |
| Comparative Example 1 | C | A |
| Comparative Example 2 | A | C |
| Comparative Example 3 | A | C |

A similar experiment was carried out using the direct drawing type ink jet recording apparatus illustrated in FIG. 2. In image formation by the direct drawing type ink jet recording apparatus illustrated in FIG. 2, GLORIA PURE WHITE with a basis weight of 210 g/m$^2$ (manufactured by Gojo Paper Mfg. co., ltd.) was used as the recording medium 208. The reaction liquid, the reaction liquid applying device 203, the ink, the ink applying device 204, the conveyance speed of the recording medium 208, and the liquid absorbing device 205 except the recording medium 208 were similar to those of the transfer type ink jet recording apparatus of Example 1, and evaluations similar to those of Example 1 were carried out. As a result, the same evaluation results as those of Example 1 were obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-016278, filed Jan. 29, 2016, which is hereby incorporated by reference herein in its entirety.

What is claimed is:

1. A method for producing a porous body for use in an ink jet recording apparatus including an image forming unit configured to form a first image including a first liquid and a coloring material on an ink receiving medium, and a liquid absorbing member including the porous body that comes into contact with the first image to absorb at least a part of the first liquid from the first image, the method comprising the steps of:

laminating a first porous layer that comes into contact with the first image and includes a first resin, a second porous layer including a second resin, and a third porous layer including a third resin; and heating the laminated first to third porous layers, wherein the second porous layer has a portion where no material is present when viewed in a thickness direction, and wherein a softening temperature T1 (° C.) of the first resin, a softening temperature T2 (° C.) of the second resin, a softening temperature T3 (° C.) of the third resin, and a heating temperature T (° C.) in the step of heating the first to third porous layers are such that T2<T, T<T1, and T<T3.

2. The method according to claim 1, wherein the second porous layer has a mesh shape.

3. The method according to claim 1, wherein the second porous layer includes fibers including the second resin, and wherein the fibers have an average diameter less than a thickness of the first porous layer and less than a thickness of the third porous layer.

4. The method according to claim 1, wherein the softening temperature T1 (° C.) of the first resin, the softening temperature T2 (° C.) of the second resin, the softening temperature T3 (° C.) of the third resin, and the heating temperature T (° C.) in the step of heating the first to third porous layers are such that T1−T≥10° C., T3−T≥10° C., and T−T2≥10° C.

5. The method according to claim 1, wherein the third porous layer has a thickness larger than a thickness of the first porous layer, and wherein in the step of heating the first to third porous layers, a heating temperature of the third porous layer is higher than a heating temperature of the first porous layer.

6. The method according to claim 1, wherein the third porous layer has a thickness larger than a thickness of the first porous layer, and wherein the third porous layer has a surface free energy higher than a surface free energy of the first porous layer.

7. The method according to claim 1, wherein the first resin comprises a fluororesin.

8. The method according to claim 1, wherein the softening temperature T1 (° C.) is 130° C. to 360° C.

9. The method according to claim 1, wherein the softening temperature T2 (° C.) is 50° C. to 150° C.

10. The method according to claim 1, wherein the softening temperature T3 (° C.) is 150° C. to 360° C.

11. The method according to claim 1, wherein the heating temperature T (° C.) is 127° C. to 230° C.

12. A porous body for use in an ink jet recording apparatus including an image forming unit configured to form a first image including a first liquid and a coloring material on an ink receiving medium, and a liquid absorbing member including the porous body that comes into contact with the first image to absorb at least a part of the first liquid from the first image, the porous body comprising:

a first porous layer that comes into contact with the first image and includes a first resin, a second porous layer including a second resin, and a third porous layer including a third resin in this order, wherein the second porous layer has a portion where no material is present when viewed in a thickness direction, and wherein the second resin enters pores in the first porous layer and in the third porous layer so that the first to third porous layers are bonded together.

13. The porous body according to claim 12, wherein the second porous layer has a mesh shape.

14. The porous body according to claim 12, wherein the second porous layer includes fibers including the second resin, and wherein the fibers have an average diameter less than a thickness of the first porous layer and less than a thickness of the third porous layer.

15. The porous body according to claim 12, wherein the third porous layer has a thickness larger than a thickness of the first porous layer, and wherein the third porous layer has a surface free energy higher than a surface free energy of the first porous layer.

16. The porous body according to claim 12, wherein a mass of the second resin that enters pores in the third porous layer is larger than a mass of the second resin that enters pores in the first porous layer.

17. The porous body according to claim 12, wherein the first resin comprises a fluororesin.

18. The porous body according to claim 12, having a Gurley value of 12.0 seconds or less.

19. An ink jet recording method comprising the steps of:

forming a first image including a first liquid and a coloring material on an ink receiving medium; and bringing the porous body according to claim 12 into contact with the first image so that the porous body absorbs at least a part of the first liquid from the first image.

20. An ink jet recording apparatus comprising:

an image forming unit configured to form a first image including a first liquid and a coloring material on an ink receiving medium; and a liquid absorbing member including the porous body according to claim 12 that comes into contact with the first image to absorb at least a part of the first liquid from the first image.

21. The ink jet recording apparatus according to claim 20, wherein the image forming unit comprises:

a device configured to apply a first liquid composition including the first liquid or a second liquid onto the ink receiving medium; and a device configured to apply a second liquid composition including either the first liquid or the second liquid and the coloring material onto the ink receiving medium, and wherein the first image is a mixture of the first and second liquid compositions, which is viscously thickened more than each of the first liquid composition and the second liquid composition.

22. The ink jet recording apparatus according to claim 20, wherein the ink receiving medium is a transfer body that temporarily holds the first image and a second image that absorbs the first liquid from the first image, and wherein the ink jet recording apparatus further comprises a transfer unit including a transfer member configured to transfer the second image onto a recording medium on which an image is to be formed.

23. The ink jet recording apparatus according to claim 20, wherein the ink receiving medium is a recording medium on which an image is to be formed.

24. An ink jet recording apparatus comprising:

an image forming unit configured to form a first image by applying an ink containing a first liquid and a coloring material on an ink receiving medium; and a liquid absorbing member including the porous body that comes into contact with the first image to concentrate the ink constituting the first image, the porous body comprising:

a first porous layer that comes into contact with the first image and includes a first resin, a second porous layer including a second resin, and a third porous layer including a third resin in this order, wherein the second porous layer has a portion where no material is present when viewed in a thickness direction, and wherein the second resin enters pores in the first porous layer and in the third porous layer so that the first to third porous layers are bonded together.

* * * * *